US008032062B2

(12) United States Patent
Aimoto

(10) Patent No.: US 8,032,062 B2
(45) Date of Patent: Oct. 4, 2011

(54) DEVELOPING UNIT AND IMAGE FORMING APPARATUS WITH MAGNET BEARING MEMBERS

(75) Inventor: Toyoka Aimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 836 days.

(21) Appl. No.: 12/076,483

(22) Filed: Mar. 19, 2008

(65) Prior Publication Data

US 2008/0253809 A1 Oct. 16, 2008

(30) Foreign Application Priority Data

Apr. 13, 2007 (JP) ..... 2007-105763

(51) Int. Cl.
*G03G 15/08* (2006.01)

(52) U.S. Cl. ..... 399/254; 399/256

(58) Field of Classification Search ..... 399/254–256
See application file for complete search history.

(56) References Cited

FOREIGN PATENT DOCUMENTS

| | | | |
|---|---|---|---|
| JP | 2005-292301 | | 10/2005 |
| JP | 2006-162948 | A | 6/2006 |
| JP | 2006-337871 | A | 12/2006 |
| JP | 2007065400 | A * | 3/2007 |

* cited by examiner

*Primary Examiner* — David Gray
*Assistant Examiner* — Laura Roth
(74) *Attorney, Agent, or Firm* — Nixon & Vanderhye, P.C.

(57) ABSTRACT

A developing unit is configured to develop an electrostatic latent image born on an image bearing member with a developer that has been charged by mixing and agitating toner and magnetic carrier. The developing unit comprises a developing hopper; a developer bearing member; and at least a pair of agitating and conveying members rotationally driven in the developing hopper. The agitating and conveying members are arranged substantially parallel to the developer bearing member and each rotational shaft of the agitating and conveying members is embedded with a magnetic source element whose magnetic poles are laid out so as to produce a magnetic field radially oriented in a particular fixed direction with respect to the agitating and conveying member.

10 Claims, 9 Drawing Sheets

DEVELOPING UNIT AND IMAGE FORMING APPARATUS WITH MAGNET BEARING MEMBERS

This Nonprovisional application claims priority under 35 U.S.C. §119(a) on Patent Application No. 2007-105763 filed in Japan on 13 Apr. 2007, the entire contents of which are hereby incorporated by reference.

BACKGROUND OF THE INVENTION (1) Field of the Invention

The present invention relates to a developing unit mounted on an image forming apparatus using electrophotography, in particular relating to an agitating and conveying device for conveying the developer to the developing area while agitating toner and carrier in a developing hopper provided for the developing unit.

(2) Description of the Prior Art

In image forming apparatuses using electrophotography such as copiers, facsimile machines, printers, so-called multi-functional machines having these functions and the like, a robust recording image can be formed by supplying toner as a component of the developer from a developing unit to the electrostatic latent image formed on the photoreceptor drum surface to form a visible toner image, transferring the toner image to a recording paper etc., as a transfer medium; and fixing the thus transferred toner image onto the recording paper.

With recent improvement in office work efficiency using image forming apparatus such as copiers, printers etc., there has been a demand for an image forming apparatus which is improved in image processing capacity, for example, in the processing speed of image forming, represented by the number of recording sheets per unit time that can be image-formed.

In the image forming apparatus having a high processing speed of image forming (high-speed machines), it is demanded that the life of the developer should be longer than that for the image forming apparatus having a medium processing speed of image forming (medium-speed and low-speed machines). The reason is that the developer or more precisely the toner is consumed in a greater amount and exposed to stress during agitation and conveyance in a higher degree compared to that of the medium and low-speed machines because a higher number of images are formed per unit time in the high-speed machine. As a result, the developer having a comparable lifetime to that of the developer used in the medium and low-speed machines will finish its life quickly, increasing the frequency of developer-related maintenance.

As one countermeasure against this problem, there is an idea to make the developing unit large. Because enlargement of the developing unit and increase in the amount of developer stored therein make it possible to deal with mass consumption of the developer in the high-speed machine, reduce the frequency with which the developer is exposed to the stress due to agitation and conveyance and also increase the lifetime.

However, it occurs frequently that the developing unit cannot be made larger in size due to structural limitations of the apparatus. Further, if the developing unit is made greater to some slight degree, it is impossible for a high-speed machine which uses a system in which toner is supplied to the developing hopper that confronts the developer bearing member, to secure long enough time to sufficiently agitate and supply uniform developer to the developer bearing member, hence it is difficult to control the toner concentration in the developer.

To deal with this, as a countermeasure against this problem, there is a proposal that the developing hopper of the developing unit is formed longer than the longitudinal length of the developer bearing member while a partitioning plate is provided between the developing area where it opposes the developing support and the portion extended longitudinally beyond the developing area so as to form an agitating area to secure uniform agitation in the agitating area.

However, even with the agitating area provided, if toner supply is performed from a position which cannot afford long enough time for agitation, the toner concentration along the longitudinal direction of the developing unit is prone to become uneven, giving rise to the problem of being unable to control the toner concentration with precision.

Further, as a method of solving the density unevenness problem due to agitation failure, patent document 1 (Japanese Patent Application Laid-open 2005-292301) discloses a configuration in which a scoop-assisting member made up of a magnetic substance is disposed between a developer bearing member and a screw-like agitator.

However, in order to obtain uniform enough images it is necessary to sufficiently agitate and mix the toner and carrier before bringing up the developer to the developer bearing member. If the scooping performance of the developer to the developer bearing member is enhanced with insufficient agitation of the developer, it is impossible to obtain homogeneous developer because the developer can be little agitated on the developer bearing member. This tendency is particularly conspicuous especially in the high-speed machines in which the holding time of the supplied developer in the developing hopper is short.

SUMMARY OF THE INVENTION

The present invention has been devised in view of the above problems with the conventional developers, it is therefore an object of the present invention to provide a novel and improved developing unit and image forming apparatus in which supplied toner can be agitated uniformly in a short time so as to stably control the toner concentration in the developer held in the developing hopper with high precision.

In order to achieve the above object, the present invention provides a developing unit for developing an electrostatic latent image born on an image bearing member with a developer that has been charged by mixing and agitating toner and magnetic carrier, comprising: a developing hopper for holding the developer; a developer bearing member for bearing the developer having been mixed and agitated in the developing hopper and supplying the developer to a developed area arranged opposing the image bearing member; and at least a pair of agitating and conveying members rotationally driven in the developing hopper for conveying the developer while agitating, characterized in that the agitating and conveying members are arranged substantially parallel to the developer bearing member and each rotational shaft of the agitating and conveying members is embedded with a magnetic source element whose magnetic poles are laid out so as to generate a magnetic field in the direction of the specific normal to the agitating and conveying member; and a toner supply port for supplying the toner into the developing hopper is arranged over the opposite position of the paired agitating and conveying members.

Owing to the above configuration, since the magnetic brushes formed by the magnetic source elements embedded in the rotational shaft of the agitating and conveying members push the magnetic carrier toward the rotational shaft at both sides, added toner can easily enter deeper into the developing hopper between the two agitating and conveying members. Accordingly, it is possible to prevent the developer surface that is formed by the developer with a content of magnetic carrier from blocking the entrance of supplied toner, which used to be troublesome in the conventional configuration. As a result, the supplied toner and the magnetic carrier can be uniformly mixed and agitated in a short time, so that it is possible to stably control the toner concentration of the developer inside the developing hopper with high precision.

In the above embodied mode, the above developing unit may be constructed such that the magnetic source elements embedded in the rotational shafts have a magnetic pole-face on the shaft surface side of each rotational shaft, and the magnetic pole-faces on the shaft surface side present the same magnetic polarity.

With this configuration, when the magnetic pole-faces of the magnetic source elements embedded in the rotational shafts of the two agitating and conveying members opposes each other, repulsive magnetic fields arise between the two rotational shafts and form spikes of the developer, which enable lumps of supplied toner to be fully crushed and agitated, thus making it possible to achieve efficient mixture and agitation of toner and magnetic carrier.

In the above embodied mode, the above developing unit may be constructed such that a magnetic element is arranged under each of the agitating and conveying members and at the bottom of the developing hopper, so that its one magnetic pole that opposes the corresponding magnetic source element has a magnetic polarity opposite that of the magnetic pole-face of the magnetic source element.

With this configuration, the magnetic elements located at the bottom stretch the spikes of the developer with a content of magnetic carrier that have been shrunken by being attracted to the rotational shaft sides by the function of the magnetic brushes formed by the magnetic source elements embedded in the rotational shafts of the agitating and conveying members. Accordingly, input toner lumps can be crushed thus making it possible to achieve efficient mixture and agitation of toner and magnetic carrier.

In the above embodied mode, the above developing unit may be constructed such that the paired agitating and conveying members are rotationally driven so that the magnetic pole-faces of the magnetic source elements embedded in the rotational shafts oppose each other in synchronism.

With this configuration, since the magnetic pole-faces of the magnetic source elements embedded in the rotational shafts of the two agitating and conveying members are adapted to oppose each other always in synchronism, the strongest repulsive magnetic fields emerge between the two rotational shafts. As a result, this repulsive magnetic fields form spikes of the developer, which enable lumps of supplied toner to be fully crushed and agitated.

In the above embodied mode, the above developing unit may be constructed such that the toner from the toner supply port is adapted to fall into the developing hopper only when the two magnetic pole-faces oppose each other.

With this configuration, lumps of supplied toner, immediately after being dropped, can be led to and between the spikes of developer formed by the repulsive magnetic fields raised between the rotational shafts, so that the toner lumps can be fully crushed and agitated.

In the above embodied mode, the above developing unit may be constructed such that the magnetic source elements embedded in the rotational shafts of the paired agitating and conveying members exert approximately equivalent magnetic forces.

With this configuration, since repulsive magnetic fields having the approximately same intensities are generated around the two rotational shafts, falling toner lumps are brought to the approximate center between the two shafts and can be fully crushed and agitated by the equivalent agitating strengths of uniform developer spikes between the two rotational shafts.

In the above embodied mode, the above developing unit may be constructed such that the paired agitating and conveying members have approximately equivalent conveying performances for conveying the developer.

With the above configuration, since it is possible to form equivalent developer spikes between the two rotational shafts, toner lumps can be fully crushed and agitated by equal agitating strengths.

In the above embodied mode, the above developing unit may be constructed such that the magnetic forces of the magnetic source elements are specified so as to be greater as the distance between the paired agitating and conveying members becomes greater.

With the above configuration, it is possible to form suitable repulsive magnetic fields depending on the distance between the two rotational shafts, hence it is possible to create optimal developer spikes between the rotational shafts. As a result, toner lumps can be fully crushed and agitated by equal agitating strengths.

In the above embodied mode, the above developing unit may be constructed such that the longitudinal length of the magnetic source element is greater than the longitudinal length of the toner supply port.

With the above configuration, it is possible to reliably create an area for accepting falling lumps of toner supplied from the toner supply port while positively avoiding hindrance during loading supply toner due to the developer with a content of magnetic carrier. As a result, all the toner lumps can be fully crushed and agitated.

In order to achieve the above object, another aspect of the present invention provides an image forming apparatus comprising: a developing unit for developing an electrostatic latent image born on an image bearing member with a developer including toner; and a transfer portion for transferring the toner image developed on the image bearing member to a recording medium to form an output image, characterized in that the developing unit employs any one of the above developing units described heretofore.

With the above configuration, since loaded supply toner can be fully crushed in a short time and mixed and agitated uniformly, it is possible to solve the density unevenness problem in the image formed on the recording medium such as paper etc., due to agitation failure. As a result, it is possible to realize an image forming process which can be applied to a high-speed machine in which supplied developer in the developing hopper is quickly consumed hence stays therein in a short period.

As has been described heretofore, according to the present invention, since it is possible to avoid hindrance during loading of supply toner due to the developer surface, hence the supplied toner can easily enter deeply into the developing hopper between the two agitating and conveying members, the supplied toner can be uniformly mixed and agitated with magnetic carrier in a short time. As a result it is possible to stably control the toner concentration of the developer inside the developing hopper with high precision, thus making it possible to prevent density unevenness in the image formed on the recording medium such as paper etc., due to agitation failure.

DESCRIPTION OF THE PREFERRED EMBODIMENTS

Figure 1:
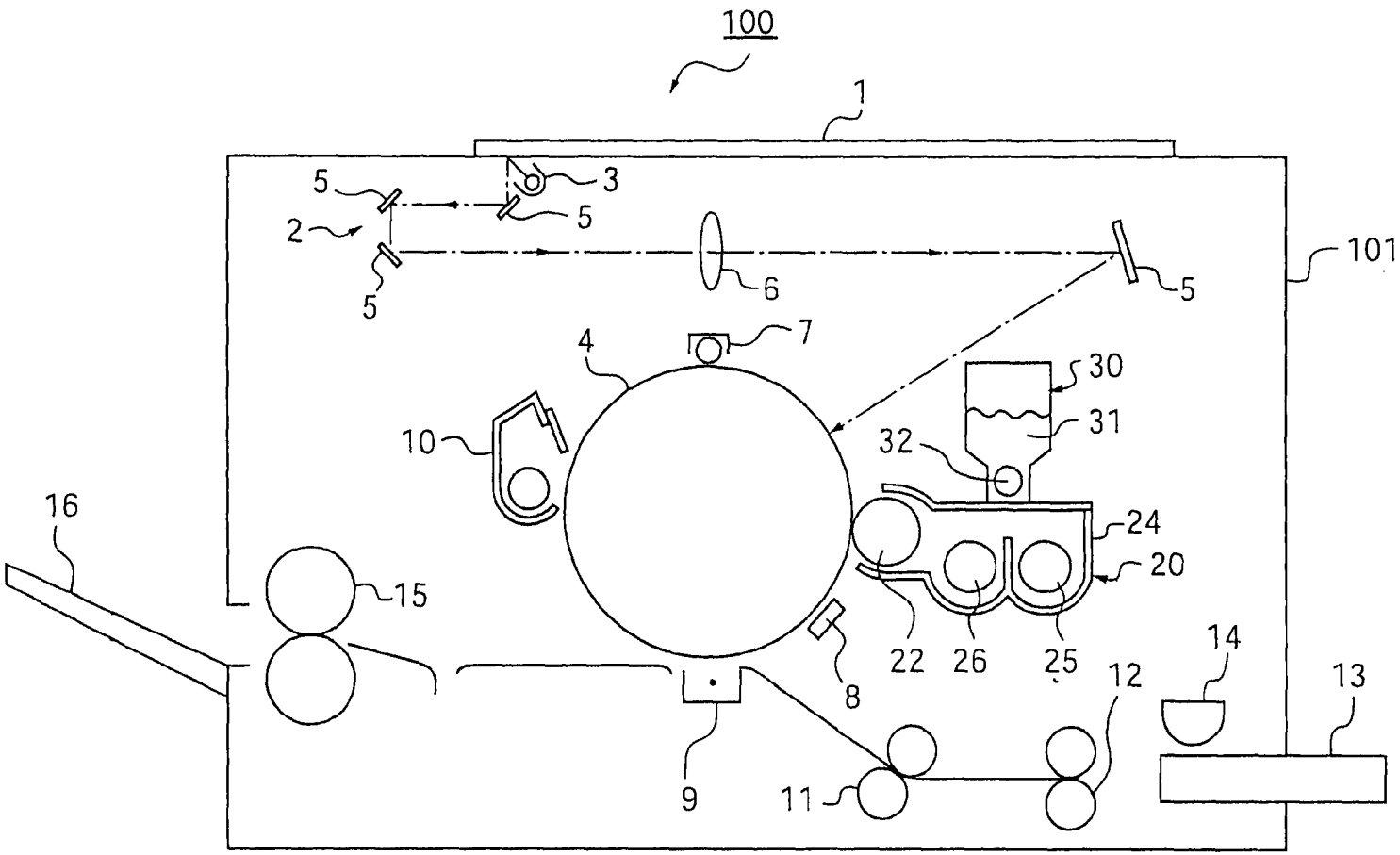
FIG. 1 is a vertical sectional view schematically showing the overall configuration of essential components in the first embodiment of an image forming apparatus using a developing unit of the present invention.

A preferred embodiment of the present invention will hereinafter be described in detail with reference to the accompanying drawings. Herein, in the description and the drawings, the components having substantially identical functions are allotted with the same reference numerals so as to avoid repeated description.

Figure 2:
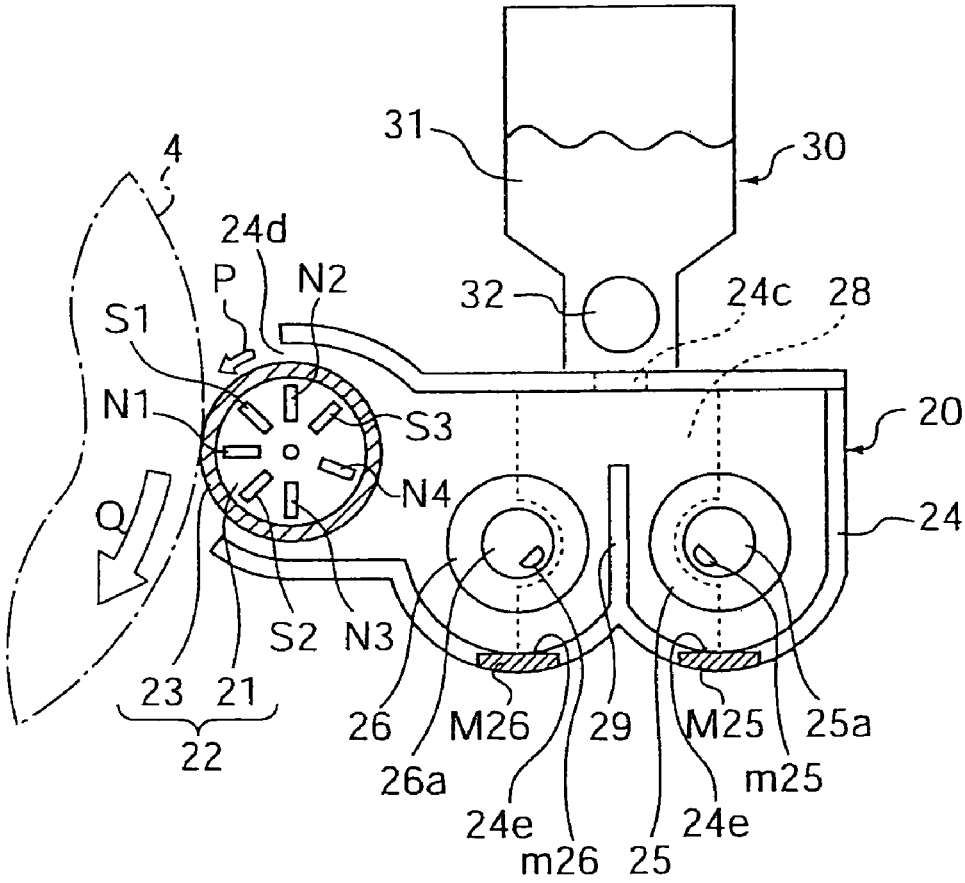
FIG. 2 is a vertical sectional view showing a developing unit provided for the image forming apparatus of the same embodiment and essential components of a toner feed device arranged in the developing unit.

To begin with, the configuration of the first embodiment of an image forming apparatus using a developing unit according to the present invention will be described using drawings. FIG. 1 is a vertical sectional view schematically showing the overall configuration of essential components of the first embodiment of an image forming apparatus using a developing unit of the present invention. FIG. 2 is a vertical sectional view showing a developing unit provided for the image forming apparatus of the embodiment and essential components of a toner feed device arranged in this developing unit. Here, for simplicity these drawings show the image forming apparatus of the present embodiment mainly with essential components but it goes without saying that the apparatus should also include unillustrated components.

As shown in FIG. 1, an image forming apparatus 100 of the present embodiment has an original placement table 1 on the top of an apparatus body 101. Arranged under this original placement table 1 are an approximately cylindrical photoreceptor drum 4 as an image bearing member having a photoconductive layer on which an electrostatic latent image is formed and an exposure optical system 2 for scanning the light of image data output from an unillustrated image processor over the peripheral surface of this photoreceptor drum 4 to write an electrostatic latent image thereon.

This exposure optical system 2 is comprised of a light source lamp 3 for illuminating and scanning the original (not shown) placed on the original placement table 1; a plurality of reflection mirrors 5 . . . for leading the reflected light from the original to photoreceptor drum 4; and a lens unit 6 arranged in the optical path of the reflected light. Here in the present embodiment, though an analog image forming apparatus including an analog optical system as exposure optical system 2 is exemplified, a digital image forming apparatus including a digital optical system using CCD sensors may be used.

Arranged around photoreceptor drum 4 are an electrification charger 7 for uniformly electrifying the peripheral surface of the photoreceptor drum 4 at a predetermined potential; a developing unit 20 for forming a toner image by developing the electrostatic latent image formed on the peripheral surface of photoreceptor drum 4 by supplying developer to the peripheral surface thereof; a charge erasing device 8 for lowering the surface potential of photoreceptor drum 4 in order to make it easy for the toner image formed on the photoreceptor drum 4 surface to transfer to paper (recording medium); a transfer charger 9 for transferring the toner image formed on the photoreceptor drum 4 surface to the printing medium, e.g., recording paper (paper); a cleaning device 10 for removing and collecting the leftover toner on the photoreceptor drum 4 surface after transfer to the recording paper, and the like.

Arranged on the paper feed side with respect to photoreceptor drum 4 are a timing roller 11 for feeding paper at a predetermined timing; a conveying roller 12 for conveying paper and a paper feed roller 14 for feeding the paper from a paper feed tray 13. In addition, a fixing unit 15 for fixing the toner image transferred to the paper thereto and a paper output tray 16 to which the paper with the toner image transferred thereon is discharged are arranged on the paper output side with respect to photoreceptor drum 4. Paper feed tray 13 may include both the paper feed cassette arranged inside apparatus body 101 and manual paper feed tray for feeding sheets of desired paper from the outside of apparatus body 101.

As shown in FIG. 2, developing unit 20 includes a developing hopper 24 that is a molding of resin or the like forming a storage receptacle for storing the developer. This developing hopper 24 includes therein first and second agitating and conveying screws 25 and 26 that function as agitating and conveying members for agitating and conveying the developer, and a developing roller 22 that is rotatably arranged and functions as a developer bearing member by magnetically attracting the developer supplied by the agitating and conveying screws 25 and 26 and bringing it to photoreceptor drum 4.

A predetermined amount (e.g., 400 g) of developer is stored in this developing hopper 24. The developer includes carrier and toner. The carrier is composed of magnetic material and has a resin-coated layer for suppressing the toner from sticking to the carrier surface. As the carrier and toner is agitated by agitating and conveying screws 25 and 26, the toner is tribo-charged.

As shown in FIG. 2 developing roller 22 is arranged a developing gap of about 0.5 to 1.5 mm apart from photoreceptor drum 4 and is comprised of a magnet roller 21 incorporating a plurality of magnetic pole elements such as bar magnets having approximately rectangular cross sections and an approximately cylindrical non-magnetic sleeve 23 consisting of aluminum alloy, brass and the like and arranged over and rotatably in one direction (in the direction of P in FIG. 2) relative to magnet roller 21.

Magnet roller 21 is constructed such that magnetic pole elements N1, N2, N3 and N4 providing N-pole magnetic fields and magnetic pole elements S1, S2 and S3 providing S-pole magnetic fields are arranged radially and apart one from another in a roughly alternating manner, forming an overall cylindrical shape. Magnet roller 21 is unrotatably supported and fixed at its both ends by the side walls of developing hopper 24 so that magnetic pole element N1 is disposed at a position opposing the peripheral surface of photoreceptor drum 4. The magnetic field produced by the thus arranged magnetic pole elements N1, N2, N3, N4, S1, S2 and S3 attracts the dual-component developer made of toner and carrier to the outer surface of sleeve 23 so as to form a magnetic brush.

Developing roller 22 is arranged so that its peripheral surface is partly exposed from an opening mouth 24*d* that is opened in developing hopper 24 and opposes photoreceptor drum 4 that is rotated in one direction (in the direction of Q in FIG. 2). This position where the developing roller and the photoreceptor drum oppose each other forms the developing position, where the electrostatic latent image formed on the peripheral surface of photoreceptor drum 4 is rubbed by the developer as it is conveyed by rotation of developing roller 22, so that the toner adhering to the carrier forming the magnetic brush is electrostatically attracted to the electrostatic latent image to thereby develop the electrostatic latent image. Details of developing unit 20 of the present embodiment will be described later.

Also as shown in FIG. 2, a toner supply port 24*c* for supplying the developer is formed on the top wall portion of developing hopper 24. A toner feed device 30 is fitted from above to this toner supply port 24*c*.

Toner feed device 30 temporarily holds the toner discharged from an unillustrated toner container filled with toner in an intermediate hopper 31 and agitates then supplies it to developing unit 20. Arranged in the bottom of toner feed device 30 is a toner feed roller 32 that is driven and controlled by a controller 80 (see FIG. 8) of image forming apparatus 100. As toner feed roller 32 is driven to rotate, toner flows down from toner feed device 30 in an amount that corresponds to the driven time of toner feed roller 32 and is fed into developing hopper 24, where the toner is agitated and conveyed by agitating and conveying screws 25 and 26.

In the present embodiment, rotational shafts 25*a* and 26*a* of first and second screws 25 and 26 respectively incorporate magnetic source elements m25 and m26 which each produce a magnetic field radially oriented in a fixed direction around the agitating and conveying screws 25 and 26. Arranged in the bottom 24*e* of developing hopper 24 on the lower side of these agitating and conveying screws 25 and 26 is magnetic elements M25 and M26 which each has a magnetic polarity opposite to that of corresponding magnetic source element m25 or m26. The detail as to these magnetic source elements m25 and m26 and magnetic elements M25 and M26 will be described later.

Figure 3:
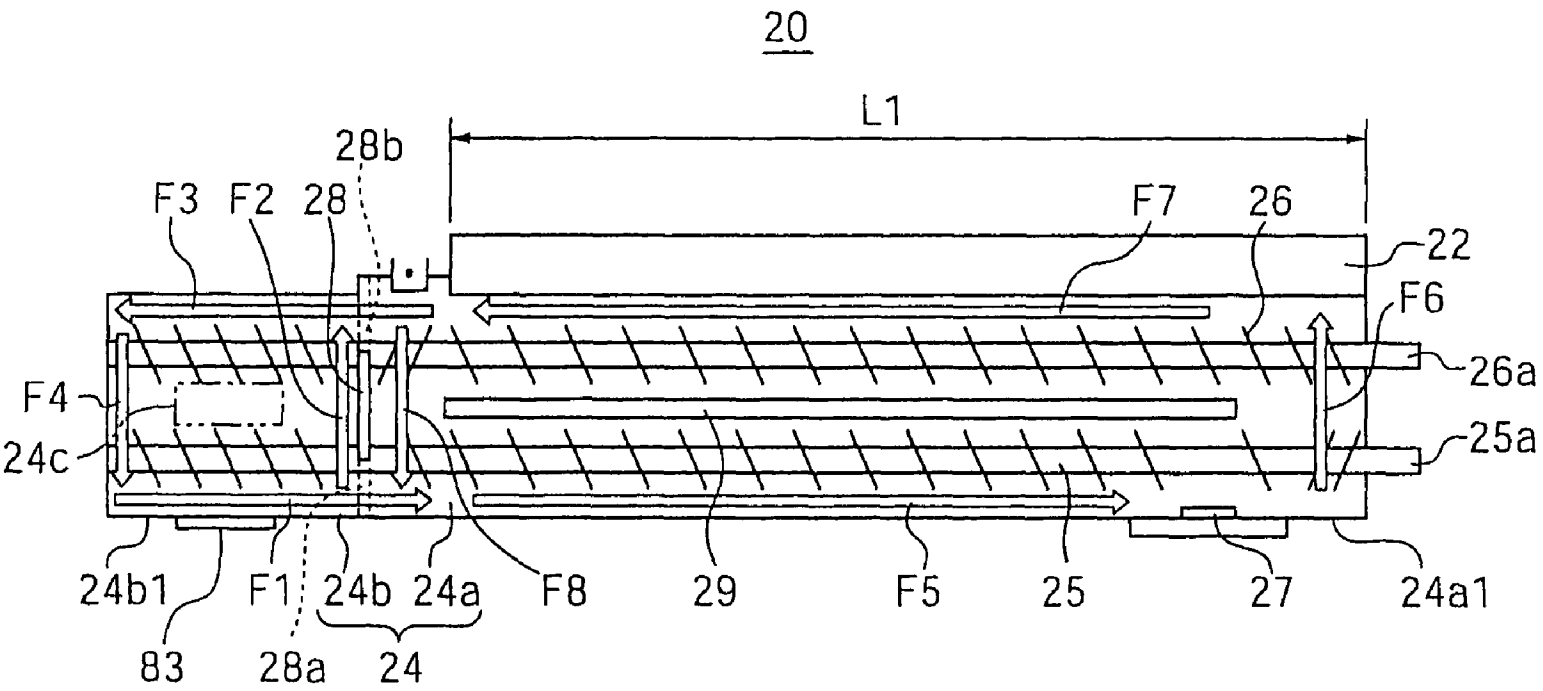
FIG. 3 is a plan view schematically showing the developing unit of the same embodiment with its top wall portion removed.

Next, the configuration of developing unit 20 of the present embodiment will be described with reference to the drawings. FIG. 3 is a plan view schematically showing the developing unit of the present embodiment with its top wall portion removed.

Developing unit 20 is roughly comprised of developing roller 22 for bearing the developer, developing hopper 24 for storing the developer, first and second agitating and conveying screws 25 and 26 for agitating and conveying the developer inside developing hopper 24 and a toner concentration detecting sensor 27 for detecting the amount of developer in developing hopper 24.

As already mentioned, developing roller 22 is composed of magnet roller 21 with a multiple number of magnetic pole elements N1, N2, N3, N4, S1, S2 and S3 arranged thereon and non-magnetic sleeve 23 rotatably arranged over the magnet roller. The developing roller 22 is laid out opposing photoreceptor drum 4 with its axis parallel to the rotational axis of photoreceptor drum 4 and supported by the frame portion of the developing unit 20 body.

As the developer born by developing roller 22, a developer including toner and carrier is used. Developing roller 22 attracts the carrier particles that carry the toner particles to the roller surface by the magnetic field from magnet roller 21 including magnetic pole elements N1, N2, N3, N4, S1, S2 and S3, forming a magnetic brush of chain-like connected spikes of developer particles from the sleeve 23 surface. In this way, the developer is born on developing roller 22 in the form of a magnetic brush. Of the developer forming the magnetic brush, toner particles bearing electricity are attracted and supplied from developing roller 22 to photoreceptor drum 4 in accordance with the potential difference between developing roller 22 and photoreceptor drum 4 to develop the electrostatic latent image and form a toner image.

Developing hopper 24 is a rectangular receptacle structure having an external shape of a parallelepiped, formed of, for example, a hard synthetic resin etc. Developing hopper 24 is formed to have a length greater than the axial length L1 of developing roller 22.

Developing hopper 24 has a developing area hopper 24*a* and an agitation area hopper 24*b*.

Developing area hopper 24*a* is formed in the part approximately corresponding to the axial length L1 of developing roller 22 to agitate and convey the developer to developing roller 22.

Agitation area hopper 24*b* is formed in the position contiguous to developing area hopper 24*a* and extended beyond the axial length L1 of developing roller 22, and agitates the toner fed from toner feed device 30 with the developer and conveys it to developing area hopper 24*a*. The agitation area hopper also collects part of the developer that was supplied to developing roller 22.

Developing hopper 24 has a partitioning wall member 28 formed therein.

This partitioning wall member 28 is arranged in developing hopper 24 such that it extends perpendicularly to the axis of developing roller 22 to partition developing hopper 24 into developing area hopper 24*a* and agitation area hopper 24*b*. Partitioning wall member 28 partitions the developing hopper into developing area hopper 24*a* and agitation area hopper 24*b* but secures communication between developing area hopper 24*a* and agitation area hopper 24*b* by forming two apertures, namely first and second apertures 28*a* and 28*b*, arranged on both sides with respect to the width or smaller dimension of the developing hopper 24, instead of completely shutting off communication between them. Accordingly, since first and second apertures 28*a* and 28*b* are provided, while developing hopper 24 is partitioned into developing area hopper 24*a* and agitation area hopper 24*b* by partitioning wall member 28, the developer held in developing hopper 24 can partly move from developing area hopper 24*a* to agitation area hopper 24*b*, and conversely the developer can also move from agitation area hopper 24*b* to developing area hopper 24*a*.

In developing hopper 24, first agitating and conveying screw 25 for agitating the developer while conveying toward developing roller 22 is rotatably arranged along the longitudinal direction of developing hopper 24 from agitation area hopper 24*b* to developing area hopper 24*a*. This first agitating and conveying screw 25 is a so-called screw member, which agitates and conveys the developer in developing hopper 24 as it rotates.

First agitating and conveying screw 25 is extended beyond the axial length L1 of developing roller 22, and conveys the developer from around its one end, namely first end 24*b*1 with respect to the longitudinal direction of developing hopper 24, which is located farthest from developing roller 22, toward partitioning wall member 28 or in the direction of arrow F1. The developer that has abutted partitioning wall member 28 is conveyed along partitioning wall member 28 in the direction of arrow F2 inside agitation area hopper 24*b*. On the other hand, the developer that has passed through first aperture 28*a* is further conveyed in the direction of arrow F5 toward developing roller 22 inside developing area hopper 24*a*. This developer's direction of conveyance from first end 24*b*1 of developing hopper 24 toward developing roller 22 will be called "outward direction" for convenience.

Also in developing hopper 24, second agitating and conveying screw 26 for agitating the developer while conveying away from developing roller 22 is rotatably arranged between developing roller 22 and first agitating and conveying screw 25 or closer to developing roller 22 than first agitating and conveying screw 25, along the longitudinal direction of developing hopper 24 from developing area hopper 24*a* to agitation area hopper 24*b*. This second agitating and conveying screw 26 is also a so-called screw member, which agitates and conveys the developer in a fixed direction inside developing hopper 24 as it rotates.

Second agitating and conveying screw 26 conveys the developer that has been conveyed to around the other end, namely, second end 24*a*1 with respect to the longitudinal direction of developing hopper 24 toward partitioning wall member 28 or in the direction of arrow F7 along developing roller 22. The developer that has abutted partitioning wall member 28 is conveyed along partitioning wall member 28 toward first agitating and conveying screw 25 or in the direction of arrow F8 inside developing area hopper 24*a*. On the other hand, the developer that has passed through second aperture 28*b* is further conveyed in the direction of arrow F3 toward first end 24*b*1 inside agitation area hopper 24*b*. This developer's direction of conveyance along the developing roller 22 from second end 24*a*1 toward first end 24*b*1 will be called "returning direction" for convenience.

Arranged inside developing area hopper 24*a* between first and second agitating and conveying screws 25 and 26 is an inter-agitator wall member 29. This inter-agitator wall member 29 is, for example a plate-like component made of synthetic resin or the like, and is extended in the longitudinal direction of developing hopper 24 and arranged so as to stand upright on the bottom of developing hopper 24 (FIG. 2). Here, inter-agitator wall member 29 is formed to be shorter than the longitudinal dimension of developing area hopper 24*a* so as to establish a developer flow from first agitating and conveying screw 25 to second agitating and conveying screw 26 in the direction of arrow F6 around second end 24*a*1 and another developer flow from second agitating and conveying screw 26 to first agitating and conveying screw 25 in the direction of arrow F8 near partitioning wall member 28.

As a result, in developing area hopper 24*a*, a circulating flow of the developer in the outgoing direction and subsequently in the returning direction, specifically a circulating developer flow indicated by arrows F5, F6, F7 and F8 in FIG. 3, is created by first and second agitating and conveying screws 25 and 26, partitioning wall member 28 and inter-agitator wall member 29.

On the other hand, inside agitation area hopper 24*b* into which toner is supplied from toner feed device 30 (FIG. 2) through toner supply port 24*c* formed on the top wall portion of agitation area hopper 24*b*, a developer flow from first agitating and conveying screw 25 to second agitating and conveying screw 26 in the direction of arrow F2 is created near partitioning wall member 28. On the other side near first end 24*b*1, a developer flow from second agitating and conveying screw 26 to first agitating and conveying screw 25 in the direction of arrow F4 is created.

As a result, in agitation area hopper 24*b*, a circulating flow of the developer in the outgoing direction and subsequently in the returning direction, specifically a circulating developer flow indicated by arrows F1, F2, F3 and F4 in FIG. 3, is created by first and second agitating and conveying screws 25 and 26 and partitioning wall member 28. This formation of the developer circulation inside agitation area hopper 24*b* contributes to mixture and agitation of the toner fed from toner feed device 30 via toner supply port 24*c* with the existing developer therein.

Figure 4:
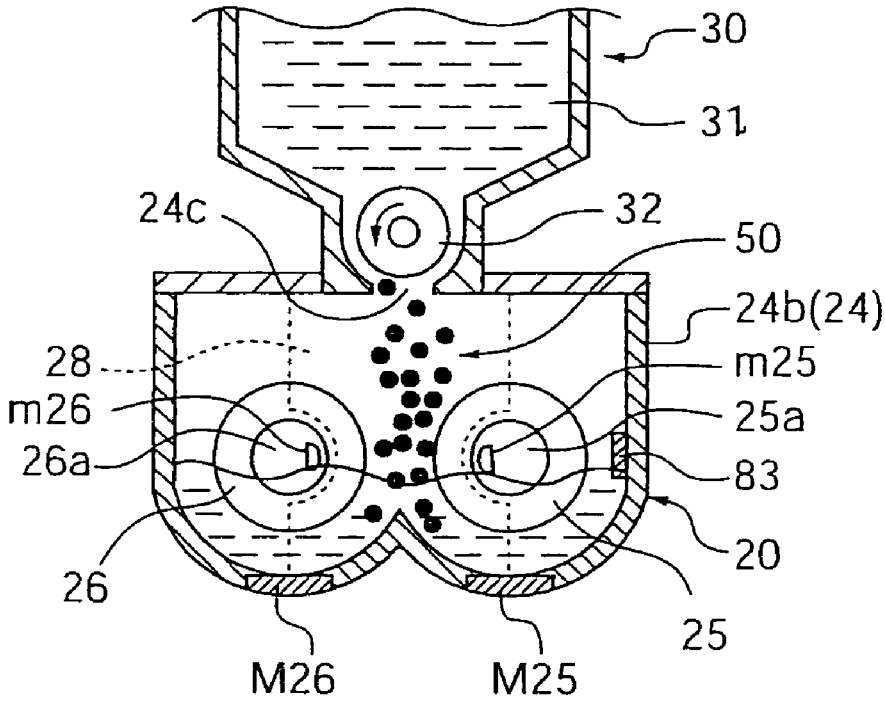
FIG. 4 is a vertical sectional view showing essential components of an agitation area hopper and a toner feed device provided for the developing unit of the same embodiment.

Now, the operational mechanism of toner supply from toner feed device 30 to developing unit 20 according to the present embodiment will be described using the drawings. FIG. 4 is a vertical sectional view showing essential components of the agitation area hopper and the toner feed device provided for the developing unit of the present embodiment.

As shown in FIG. 4, in the present embodiment toner feed device 30 is arranged over the agitation area hopper 24*b* side of the developing hopper 24. Agitation area hopper 24*b* and toner feed device 30 are connected to each other via toner supply port 24*c* formed on the upper wall side of agitation area hopper 24*b*. Intermediate hopper 31 as a toner hopper for temporarily storing and agitating the toner discharged from an unillustrated toner container provided for toner feed device 30 is a receptacle member formed of a hard synthetic resin or the like, for example, and holds the toner therein.

Toner feed device 30 rotates toner feed roller 32 in accordance with the operation command from controller 80 (see FIG. 8) to supply the toner to agitation area hopper 24*b* side of developing hopper 24. As shown in FIG. 4, toner feed roller 32 is arranged approximately directly above agitation area hopper 24*b* so that it rotates with its peripheral surface being in sliding contact with toner supply port 24*c*. In the mode of the present embodiment, toner feed roller 32 is formed of a metal core that is covered with an approximately cylindrical porous elastic member such as foamed urethane or the like. The toner retained by the porous elastic member of toner feed roller 32 inside intermediate hopper 31 drops off toner feed roller 32 by the frictional sliding action between toner supply port 24*c* and toner feed roller 32 to be supplied to agitation area hopper 24*b* side of developing hopper 24.

As stated already, rotational shafts 25*a* and 26*a* of first and second agitating and conveying screws 25 and 26 respectively incorporate magnetic source elements m25 and m26. In the present embodiment, toner supply is effected when these magnetic source elements m25 and m26 oppose each other. In this process, in order to make toner 50 supplied from toner feed device 30 fall between first and second agitating and conveying screws 25 and 26, toner supply port 24*c* is arranged above and over the opposite position between the first and second agitating and conveying screws 25 and 26 in agitation area hopper 24*b*.

In the present embodiment, in order to assure execution of toner supply from toner feed device 30 when magnetic source elements m25 and m26 embedded in rotational shafts 25*a* and 26*a* oppose each other, a magnetic force sensor 83 for detecting the magnetism produced by magnetic source elements m25 and m26 is provided on a side wall portion in agitation area hopper 24*b* of developing hopper 24 as shown in FIGS. 3 and 4. As shown in FIGS. 3 and 4, this magnetic force sensor 83 is disposed on the right-hand side wall portion of agitation area hopper 24*b* in the present embodiment because it is sufficient if the magnetism from either agitating screw 25 or 26 is detected when the agitating screws 25 and 26 rotate in synchronism. The means for detecting the state when the magnetic source elements m25 and m26 oppose each other is not limited to magnetic force sensor 83 of this embodiment, but may use a magnetic force sensor 83 that is provided at a rotational position of the extended part or may use an optical sensor and the like to perform detection.

In agitation area hopper 24*b*, part of the developer supplied with toner 50 is conveyed through first aperture 28*a* into developing area hopper 24*a* from agitation area hopper 24*b* by first agitating and conveying screw 25 while the other part of the developer abuts partitioning wall member 28 and is conveyed along partitioning wall member 28, forming the aforementioned circulating flow (the flow indicated by arrows F1, F2, F3 and F4) inside agitation area hopper 24*b*. In this circulating process, the developer is mixed and agitated by first and second agitating and conveying screws 25 and 26.

Further, the circulating flow of the developer formed in agitation area hopper 24*b* is high in toner concentration because toner is supplied from toner feed device 30. On the other hand, the circulating flow of the developer in developing area hopper 24*a* is low in toner concentration because the toner is consumed for development. These two circulating flows formed in the agitation area hopper 24*b* and developing area hopper 24*a* are mixed through first and second apertures 28*a* and 28*b* of partitioning wall member 28 that establish communication between two separate area hoppers 24*a* and 24*b*.

In the present embodiment, developing unit 20 has a toner concentration detecting sensor 27 for detecting the amount of the developer in developing hopper 24 as shown in FIG. 3. This toner concentration detecting sensor 27 may use a permeameter or a piezoelectric sensor. Disposition of toner concentration detecting sensor 27 inside developing hopper 24 enables detection of the toner quantity in the developer or in other words, the toner concentration as the ratio of combination of carrier and toner.

Toner concentration detecting sensor 27 is provided inside developing area hopper 24*a*, on the upstream side of developing roller 22 with respect to the direction of agitating and conveying the developer, or more specifically, attached to the wall portion of developing area hopper 24*a* around second end 24*a*1 of developing hopper 24 so as to oppose first agitating and conveying screw 25 to detect the toner concentration of the developer in developing hopper 24.

Provision of concentration detecting sensor 27 near second end 24*a*1 of developing hopper 24 as stated above makes it possible to perform measurement before the developer is supplied to developing roller 22 or to detect the toner concentration of the developer that has yet to be used for development.

In response to the detection output of the toner concentration from toner concentration detecting sensor 27, controller 80 (see FIG. 8) of image forming apparatus 100 rotates toner feed roller 32 of toner feed device 30 to feed toner into agitation area hopper 24*b*.

In the present embodiment the toner concentration of the developer can be adjusted with a high precision so as to be suitable for use by detecting the toner concentration of the developer that has not yet been supplied for development in the above way. Details of the operational control of supplying toner to developing unit 20 of the present embodiment will be described later.

Figure 5A:
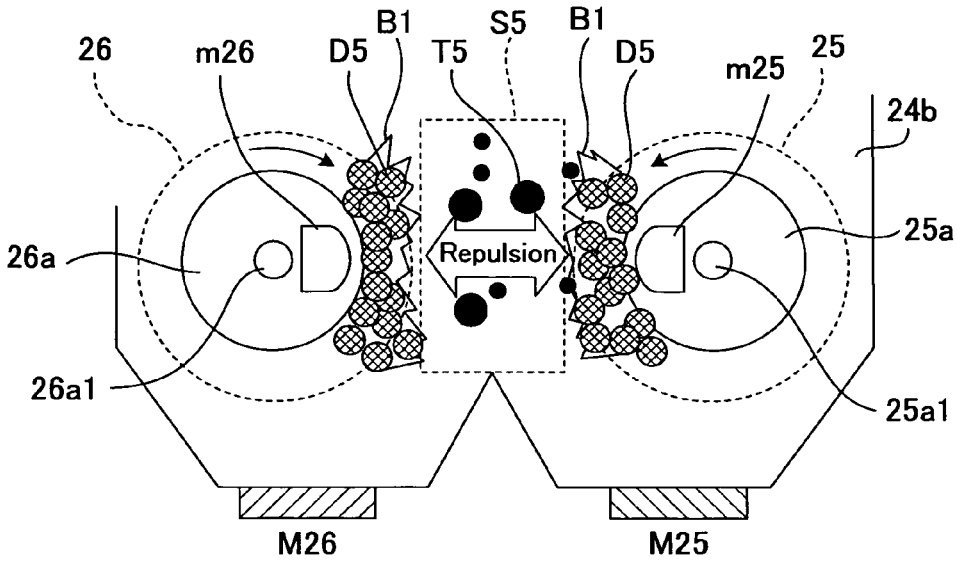
FIGS. 5A and 5B are sectional views of the interior of a developing hopper for illustrating the conditions of the toner supplied in the developing hopper of the developing unit of the same embodiment, FIG. 5A showing the condition immediately after the toner is supplied into the developing unit and FIG. 5B showing the condition in which the toner after it is supplied in the developing hopper is crushed therein.
Figure 5B:
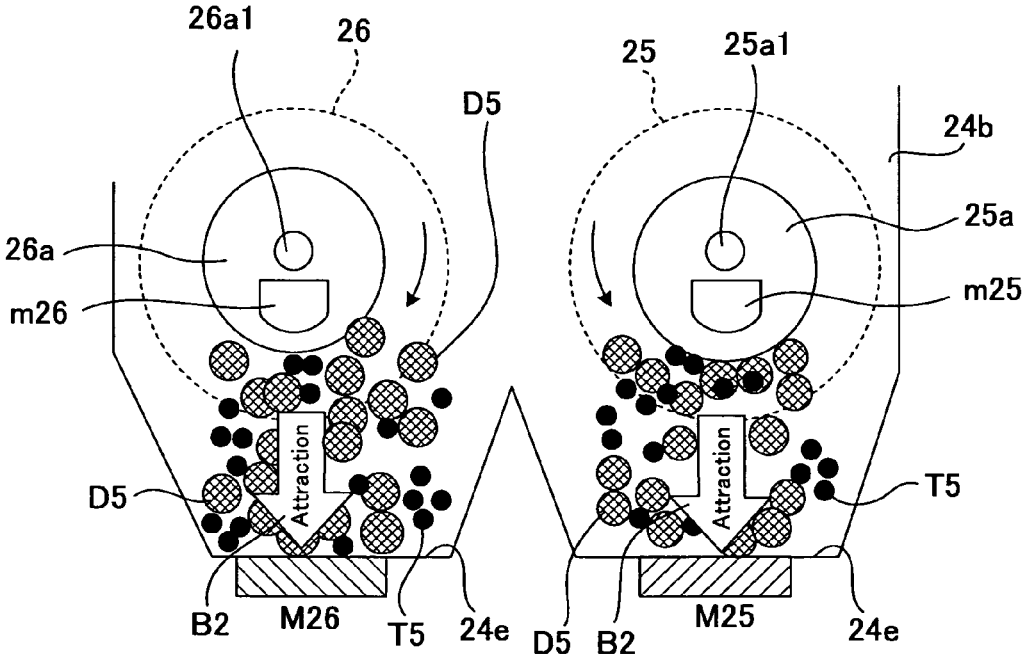
Figure 6:
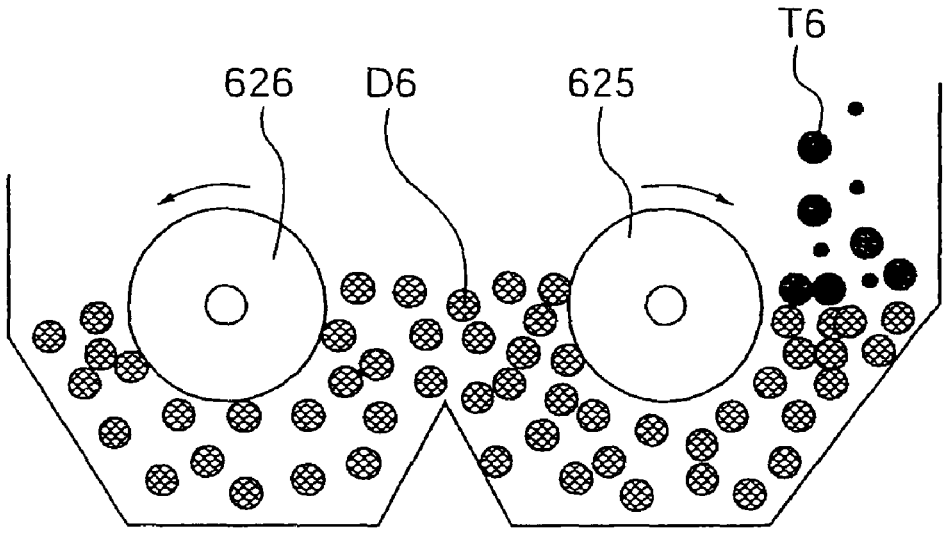
FIG.6 Prior Art
FIG. 6 is a sectional view showing as a comparative example the interior of a developing hopper for illustrating the condition when toner is supplied to the developing hopper of a conventional developing unit.

Next, the condition when toner is supplied into the developing hopper of the developing unit of the present embodiment will be described using the drawings. FIGS. 5A and 5B are sectional views of the developing hopper for illustrating the conditions of the toner supplied in the developing hopper of the developing unit of the embodiment. FIG. 5A shows the condition immediately after the toner is supplied into the developing unit and FIG. 5B shows the condition in which the toner after it is supplied in the developing hopper is crushed therein. FIG. 6 is a sectional view showing as a comparative example the interior of a developing hopper for illustrating the condition when toner is supplied to the developing hopper of a conventional developing unit.

In the present embodiment, rotational shafts 25*a* and 26*a* of first and second agitating and conveying screws 25 and 26 have a magnetic source element made of ferrite, alnico, rare-earth or other permanent magnet therein. More specifically, rotational shaft 25*a* of first agitating and conveying screw 25 has embedded shaft-side magnet m25 functioning as a magnetic source element with its magnetic poles arranged so as to generate a magnetic field that is oriented to a particular radial direction from first agitating and conveying screw 25. Similarly, rotational shaft 26*a* of second agitating and conveying screw 26 has embedded shaft-side magnet m26 functioning as a magnetic source element having its magnetic poles arranged so as to generate a magnetic field that is oriented to a particular radial direction from second agitating and conveying screw 26.

As shown in FIG. 5, these shaft-side magnets m25 and m26 are embedded in the shafts, off-centered respectively from rotational centers 25*a*1 and 26*a*1 with respect to the radial direction of rotational shafts 25*a* and 26*a*. Accordingly, as the first and second agitating and conveying screws 25 and 26 rotate, the positions of these shaft-side magnets m25 and m26 move, whereby the orientations of the magnetic fields generated thereby also change. In the present embodiment, as to the magnetic pole-faces for generating the magnetic fields of these shaft-side magnets m25 and m26, the first and second agitating and conveying screws 25 and 26 are rotationally driven in such a synchronized manner that when, for example, shaft-side magnet m25 is in a 9 o'clock position the other shaft-side magnet m26 is positioned in 3 o'clock position.

Further, the magnet pole-faces of shaft-side magnets m25 and m26 that are located close to their surface of the rotational shafts 25*a* and 26*a* have the same polarity, e.g., N-pole in this case. Here, since in this embodiment, first and second agitating and conveying screws 25 and 26 are set to rotate at the same rotational rate, these magnetic pole-faces of shaft-side magnets m25 and m26 will oppose each other always at the same position.

Accordingly, in the horizontal area where the two magnetic pole-faces of shaft-side magnets m25 and m26 oppose each other, a pair of magnetic brushes B1 of the developer are raised by magnetic repulsion between these shaft-side magnets m25 and m26. Under this condition, in order to agitate toner lumps T5 falling by developer spikes of the magnetic brushes B1 formed by the repulsion between the two rotational shafts 25*a* and 26*a* with equal agitating strengths, the magnetic forces (magnetic flux densities) of shaft-side magnets m25 and m26 as the magnetic source elements provided inside rotational shafts 25*a* and 26*a* of first and second agitating and conveying screws 25 and 26 and the conveying performances of first and second agitating and conveying screws 25 and 26 are set to be equal to that specified in example 1 below.

Alternately, as in example 2 below, if the magnetic forces of shaft-side magnets m25 and m26 provided inside first and second agitating and conveying screws 25 and 26 are dissimilar, the conveying performances of first and second agitating and conveying screws 25 and 26 may be adaptively made different so that the resultant agitating strengths of first and second agitating and conveying screws 25 and 26 will become equal. In this case, the conveying performances of first and second agitating and conveying screws 25 and 26 may be varied based on the rate of rotation and others.

EXAMPLES OF MAGNETIC FLUX DENSITY AND CONVEYING PERFORMANCE

Example 1

Magnetic flux density m25: 70 mT, m26: 70 mT

Conveying performance m25: 1500 g/min, m26: 1500 g/min

Example 2

Magnetic flux density m25: 60 mT, m26: 80 mT

Conveying performance m25: 1700 g/min, m26: 1300 g/min

Though the above description suggests that it is preferable that the agitating strengths of first and second agitating and conveying screws 25 and 26 are equal, if the agitating strengths of first and second agitating and conveying screws 25 and 26 are unequal, the effect of the present invention deriving from the inclusion of magnetic source elements m25 and m26 inside rotational shafts 25*a* and 26*a* of first and second agitating and conveying screws 25 and 26 can be obtained. In other words, when the magnetic strengths of shaft-side magnets m25 and m26 embedded in rotational shafts 25*a* and 26*a* of first and second agitating and conveying screws 25 and 26 are set approximately equal, approximately the same strength of repulsive magnetic fields are generated around the two rotational shafts 25*a* and 26*a*. As a result, falling toner lumps T5 come to move to the approximate center between the two shafts, hence the toner lumps T5 will be crushed and agitated by the equal agitating strengths of the uniform developer spikes between the two rotational shafts. Similarly, when the conveying performances of first and second agitating and conveying screws 25 and 26 are set approximately equal, equivalent developer spikes are formed between the two rotational shafts, so that the toner lumps will be fully crushed and agitated by the equal agitating strengths.

On the other hand, at the bottom 24*e* of developing hopper 24 under first and second agitating and conveying screws 25 and 26, magnetic elements M25 and M26 providing magnetic fields of an opposite polarity to that of the magnetic pole-faces of magnetic source elements m25 and m26 embedded in rotational shafts 25*a* and 26*a* are arranged so as to correspond to the agitating and conveying screws 25 and 26, respectively. These magnetic elements M25 and M26 are of a metal plate or the like having magnetism, and are made of a ferromagnetic material such as iron, cobalt, nickel or the like or a ferrite, alnico, rare-earth or other permanent magnet. Accordingly, when magnetic source elements m25 and m26 embedded in rotational shafts 25*a* and 26*a* are located vertically downwards in a 6 o'clock position, or the magnetic pole-faces of the magnetic source elements m25 and m26 are oriented vertically downwards, the magnetic poles of the magnetic source elements m25 and m26 and the magnetic elements M25 and M26 having the opposite polarity form attractive magnetic brushes B2.

When, in the conventional developing unit, an added supply of toner is dropped down over agitating and conveying portions 625 and 626 in the developing hopper as shown in FIG. 6, because of a significant difference in specific weight between developer D6 containing magnetic carrier and toner T6, input of toner T6 is blocked by the developer surface formed by the developer D6 so that it is difficult for supplied toner T6 to penetrate into developer D6 and uniformly mix therewith.

On the other hand, in the present embodiment, when first and second agitating and conveying screws 25 and 26 rotate so as to cause shaft-side magnets m25 and m26 embedded in rotational shaft 25*a* and 26*a* to oppose each other, the magnetic repulsion between these shaft-side magnets m25 and m26 form magnetic brushes B1 so as to attract developer D5 present between the rotary shafts to rotational shafts 25*a* and 26*a*. As a result, developer D5 residing between these rotational shafts 25*a* and 26*a* becomes sparse. Accordingly, as supplied toner T5 is made to fall around the developer sparse area S5 between the rotational shafts, the added toner T5 easily penetrates into the developer.

Thereafter, as shaft-side magnets m25 and m26 embedded in rotational shafts 25*a* and 26*a* become closer to magnetic elements M25 and M26 with the rotation of rotational shafts 25*a* and 26*a* as shown in FIG. 5B, attractive magnetic brushes B2 rise up between shaft-side magnet m25 and magnetic element M25 and between shaft-side magnet m26 and magnetic element M26. The attraction of this attractive magnetic brushes B2 becomes greater as shaft-side magnets m25 and m26 come to closer to magnetic elements M25 and M26. Accordingly, the spikes of developer D5 that have once shrunken by formation of magnetic brushes B1 are stretched by attraction of attractive magnetic brush B2 so that the added toner lumps T5 are crushed and newly added toner lumps T5 contained in magnetic brush B1 are broken into pieces, thus admixture of toner T5 into developer D5 is much more promoted.

Figure 7:
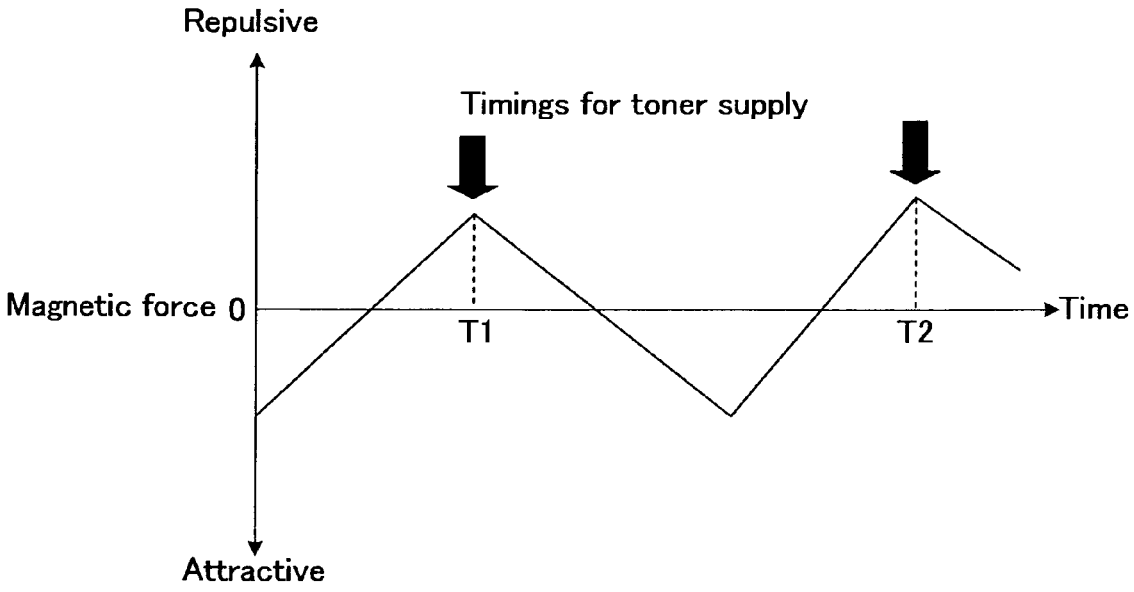
FIG. 7 is a chart showing the timings at which toner is supplied to the developing unit of the same embodiment.

Now, the timing at which toner is supplied from toner feed device 30 to developing hopper 24 of developing unit 20 in the present embodiment will be described using the drawings. FIG. 7 is a graph showing the timing at which toner is supplied to the developing unit of the present embodiment, showing the relationship of the magnetic field generated between first and second agitating and conveying screws depending on time.

As described above, since shaft-side magnets m25 and m26 are embedded in rotational shafts 25*a* and 26*a* of first and second agitating and conveying screws 25 and 26, at positions off-centered respectively from rotational centers 25*a*1 and 26*a*1 of rotational shafts 25*a* and 26*a*, the positions of these shaft-side magnets m25 and m26 move as the first and second agitating and conveying screws 25 and 26 rotate, whereby the orientations of the magnetic fields generated thereby also change. Accordingly, the magnetic force generated between the rotational shafts changes as first and second agitating and conveying screws 25 and 26 rotate. In addition, since the outer side magnetic pole-faces of shaft-side magnets m25 and m26 in the rotational shafts have the same polarity, these magnetic pole-faces of shaft-side magnets m25 and m26 exert repulsive magnetic forces repelling each other when these faces oppose one another. Thereafter, with rotation of first and second agitating and conveying screws 25 and 26, these magnetic pole-faces become away from each other and approach magnetic elements M25 and M26 provided at bottom 24*e* of developing hopper 24 so as to generate attractive forces.

A supply of fresh toner from toner feed device 30 to the agitation area hopper 24*b* side is made through toner supply port 24*c* provided over the two agitating and conveying screws 25 and 26 as stated above. In the present embodiment, the toner supply is executed only when magnetic brushes B1 are formed (at times T1 and T2 shown in FIG. 7) by the two magnetic pole-faces of shaft-side magnets m25 and m26 opposing each other. In order to make it easy to mix the fresh toner with the developer, the toner is thrown down to the area where the magnetic carrier becomes sparse when the two magnetic pole-faces of shaft-side magnets m25 and m26 oppose each other, that is, the approximate center area between the magnetic brushes B1 formed on both the opposing faces of rotational shafts 25*a* and 26*a*.

Thus, by setting up the developing unit 20 of the present embodiment with the arrangement and operational control conditions as above, it is possible to sufficiently mix and agitate the supplied toner with the existing developer to form a uniform compound of developer and supply it to developing roller 22, without increasing first and second agitating and conveying screws 25 and 26 in rotational speed even when image forming apparatus 100 to which developing unit 20 is set is a high-speed machine. As a result, it is possible to alleviate stress on the developer, hence increase the life of developer.

The above description of the embodiment has been made assuming that first and second agitating and conveying screws 25 and 26 respectively have the same configurations and include equivalent shaft-side magnets m25 and m26 of equal magnetic strengths. However, they need not to be necessarily identical as long as they can raise the equivalent chains of magnetic brushes and function as the agitating and conveying members providing equivalent developer conveying performance.

For example, as to the magnetic force of shaft-side magnets m25 and 26, if the horizontal distance between first and agitating and conveying screws 25 and 26 is set greater, the same effect can be obtained by setting the magnetic strengths of these shaft-side magnets m25 and m26 to be greater depending on the distance. That is, when the magnetic strengths of shaft-side magnets m25 and m26 are increased with increase in the horizontal distance therebetween, it is possible to create suitable repulsive magnetic fields corresponding to the distance between the two rotational shafts. Accordingly, it possible to form optimal developer-chained spikes between the two rotational shafts, hence sufficiently crush toner lumps with uniform agitating force.

In addition, in the present embodiment, the longitudinal length of toner feed roller 32 is specified to be smaller than that of agitation area hopper 24*b*, because if toner is fed to the side walls of the developing receptacle, the toner near the side walls cannot be sufficiently conveyed but will stagnate therein due to the structural configuration of the agitating and conveying members. In the worst case, it would occur that the bearings that support the agitating and conveying members are locked.

Further, in order to enable all the supplied toner to be fully mixed by magnetic brushes B1, the longitudinal lengths of shaft-side magnets m25 and m26 are specified to be greater than that of toner feed roller 32. In this way, it is possible to reliably create the developer density sparse portion S5 for the area to which the toner supplied from the toner supply port is dropped while positively avoiding hindrance in loading supply toner due to the developer with a content of magnetic carrier, which has been conventionally troublesome. As a result, all toner lumps T5 can be fully crushed and agitated.

Additionally, in order to enable the supplied toner to be fully mixed by magnetic brushes B2, it is preferable that the longitudinal lengths of magnetic elements M25 and M26 are equal to or greater than those of shaft-side magnets m25 and m26. The widths of magnetic elements M25 and M26 are also preferably specified in a similar manner.

Here, specifications for one example of developing unit 20 of the present embodiment will be given for reference. However, the specifications are not particularly limited to the following figures.

Figure 8:
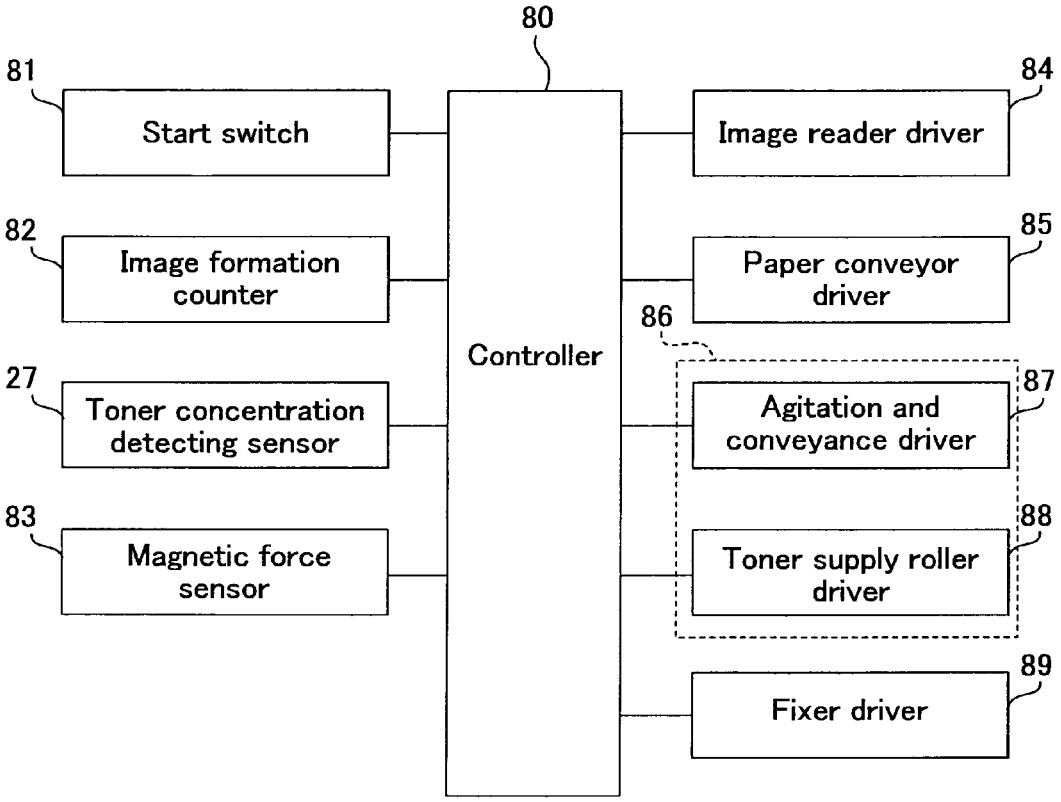
FIG. 8 is a block diagram showing an overall configuration of a controller of the image forming apparatus of the same embodiment.

- Diameter of the agitating and conveying member=20 mm
- Pitch between agitating blades=25 mm
- Rotational rate of the agitating and conveying member=150 rpm
- Length of the agitation area hopper=50 to 80 mm
- Horizontal distance between first and second agitating and conveying screws=25 mm
- Magnetic field intensity of the magnetic source element=50 to 100 mT
- Carrier size=40 μm
- Toner size=7 μm
- Rate of conveyance by the agitating and conveying screw=1400 to 2000 g/min Next, the control system of image forming apparatus 100 including a developing unit of the present invention will be described using the drawing. FIG. 8 is a block diagram showing a configuration of a controller of the image forming apparatus according to the present embodiment.

All the operations in image forming apparatus 100 having developing unit 20 of this embodiment are executed by controlling individual components of image forming apparatus 100 by means of a controller 80 that includes an unillustrated CPU, ROM and RAM.

The turn-on signal from a start switch 81 is input to controller 80. Image forming apparatus 100 of the present embodiment includes an image formation counter (measuring portion) 82 for counting the total number of times of image forming operations. This count value is also input to controller 80.

When the turn-on signal from start switch 81 is input to controller 80, an image reader driver 84 for driving light exposure system 2 and other related components for effecting an image reading and processing of desired image data to be formed on paper starts to operate.

Further, when the turn-on signal from start switch 81 is input to controller 80, a paper conveyor driver 85 that drives timing roller 11, conveying roller 12 and paper feed roller 14, etc. to perform paper conveyance, an image formation driver 86 for driving developing unit 20, toner feed device 30 and the like to perform an image forming process and a fixer driver 89 for driving fixing unit 15 etc., to perform a fixing process, start to operate.

Image formation driver 86 includes an agitation and conveyance driver 87 for rotationally driving agitating and conveying screws 25 and 26 in developing unit 20 and a toner feed roller driver 88 for rotationally driving toner feed roller 32 of toner feed device 30.

Toner concentration detecting sensor 27 has the function of detecting the toner concentration inside developing hopper 24. As the image forming operation as above is repeatedly executed, the toner of the developer stored in developing hopper 24 of developing unit 20 is gradually consumed so that the ratio of toner to carrier, or the toner concentration lowers. Toner concentration detecting sensor 27 detects the change of the toner concentration in developing hopper 24. Controller 80, based on the detected signal from the toner concentration detecting sensor 27, controls and drives toner feed roller driver 88 to rotationally drive toner feed roller 32.

Magnetic force sensor 83 is a magneto-sensor for detecting the magnetic intensity of magnetism generated between rotational shafts 25*a* and 26*a* of first and second agitating and conveying screws 25 and 26. This magnetic force sensor 83 detects whether the magnetic pole-faces of shaft-side magnets m25 and m26 embedded in rotational shafts 25*a* and 26*a* are opposing each other. In the present embodiment, when the relationship in which the magnetic pole-faces of shaft-side magnets m25 and m26 are opposing each other is detected by magnetic force sensor 83, toner feed roller driver 88 starts to rotationally drive toner feed roller 32 to thereby feed toner from toner feed device 30 into developing hopper 24.

There are cases where it is preferable that the rotational drive of toner feed roller 32 is turned on and/or off by taking into account the time delay taken for toner to fall from toner supply port 24*c* and reach the area of magnetic brushes B1, based on the above drive control. Accordingly, the aforementioned relationship in which the magnetic pole-faces of shaft-side magnets m25 and m26 are opposing each other indicates either the positional range from when magnetic brushes B1 formed by shaft-side magnets m25 and m26 appear to when they disappear or the positional range of which the rotational phase of shaft-side magnets m25 and m26 is advanced from the above positional range by the aforementioned time delay.

In sum, when the fact that the toner concentration has lowered to the lower limit of the suitable range required for development is detected based on the detected signal from toner concentration detecting sensor 27 and the relationship in which the magnetic pole-faces of shaft-side magnets m25 and m26 of first and second agitating and conveying screws 25 and 26 are opposing each other is detected, controller 80 starts rotationally driving toner feed roller 32 in toner feed device 30. Then, toner inside intermediate hopper 31 of toner feed device 30 is delivered to developing hopper 24, so that the toner concentration in developing hopper 24 increases.

Subsequently, when the fact that the toner concentration has increased to the upper limit of the suitable range is detected based on the detected signal from toner concentration detecting sensor 27, controller 80, instead of starting rotational drive of toner feed roller 32, keeps stopping it. In this way, the toner concentration in developing hopper 24 can be controlled and maintained within the suitable range. The toner supplied into developing hopper 24 is agitated and mixed with the existing developer in developing hopper 24 so that the developer is adjusted to have the predetermined static charge quantity and then is supplied by means of developing roller 22 to photoreceptor drum 4 to be used for development.

When image forming apparatus 100 of the present embodiment equipped with the above-described controller 80 is used for image forming, for example a copying operation, the power switch (not shown) is turned on, and a warming up process of image forming apparatus 100 starts. When start switch 81 is operated after completion of this warming up process, the original placed on original placement table 1 is scanned by light source lamp 3 of exposure optical system 2. In this while, the reflected light from the original is led to illuminate photoreceptor drum 4 by way of reflection mirror 5 . . . and lens unit 6 so that an electrostatic latent image is formed on the peripheral surface of photoreceptor drum 4 that has been charged at the predetermined potential by electrification charger 7.

After formation of the electrostatic latent image, this electrostatic latent image is developed by the developer including toner that is supplied from developing unit 20. The toner image formed on the peripheral surface of photoreceptor drum 4 is transferred by transfer charger 9 to the paper that is fed from paper feed cassette 13, then the image is thermally fixed to the paper. Thus, a copied image corresponding to the original image is completed on the paper by the process described above.

Figure 9:
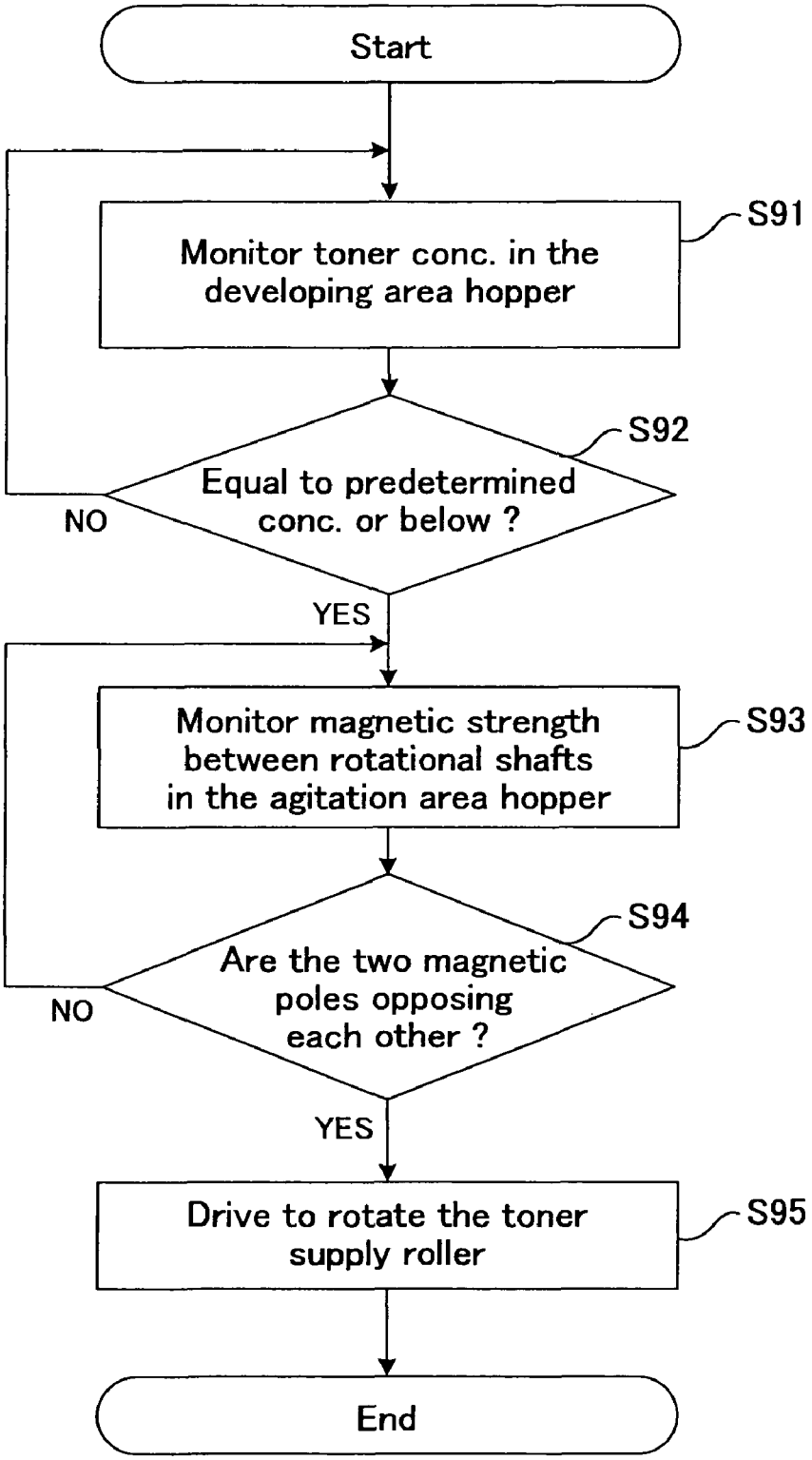
FIG. 9 is a flow chart for explaining the operation of supplying toner to the developing unit of the same embodiment.

Next, the operation of supplying toner from the toner feed device to the developing unit of the present embodiment will be described with reference to the drawing. FIG. 9 is a flow chart for explaining the operation of supplying toner to the developing unit of this embodiment.

As described above, developing unit 20 of this embodiment has toner concentration detecting sensor 27 on the developing area hopper 24*a* side of the developing hopper 24 so as to monitor the concentration density in developing area hopper 24*a* with this toner concentration detecting sensor 27 (Step S91).

Toner concentration detecting sensor 27 detects whether the toner concentration in developing area hopper 24*a* of developing hopper 24 lowers to the lower limit of the suitable range for development or below (Step S92). If the toner concentration is determined to be equal to or lower than the predetermined concentration at Step S92, the magnetic field between rotational shafts 25*a* and 26*a*, monitored by magnetic force sensor 83 is checked (Step S93).

Then, it is detected whether the magnetic pole-faces of shaft-side magnets m25 and m26 embedded in rotational shafts 25*a* and 26*a* are opposing each other (Step S94), and when it is determined that the magnetic pole-faces of shaft-side magnets m25 and m26 are opposing each other, toner feed roller driver 88 operates to rotationally drive toner feed roller 32 to start toner supply from toner feed device 30 to developing hopper 24 (Step S95).

By repeating this cycle from Step S91 to Step S95 to supply toner from toner feed device 30, it is possible to increase the toner concentration in developing hopper 24 (developing area hopper 24*a*) of developing unit 20. When it is detected based on the detected signal from toner concentration detecting sensor 27 that the toner concentration has reached the upper limit of the suitable range for development, then toner feed roller 32 is not activated to rotate but is kept stopping, to thereby maintain the toner concentration in developing hopper 24 within the predetermined suitable range.

As described heretofore, in the present invention, the rotational shafts of a pair of agitating and conveying members that are arranged approximately parallel to the developing roller in the developing hopper of the developing unit are each embedded with a magnetic source element that produces a magnetic field radially oriented in a fixed direction while the magnetic pole-faces on the shaft surface side of the rotational shafts are arranged to have the same polarity. In this configuration, repulsive magnetic fields that are formed when the magnetic pole-faces oppose each other as the agitating and conveying members are rotationally driven causes the developer with a content of magnetic carrier to become sparse in the approximately center area between the two rotational shafts. Under this condition, toner is fed to the area where the developer has become sparse, so that the supplied toner can easily penetrate deeper inside the developing hopper. As a result, the supplied toner and the magnetic carrier can be uniformly mixed and agitated in a short time without driving agitating and conveying members in high rotational speed, so that it is possible to stably control the toner concentration of the developer inside developing hopper with high precision.

Since provision of magnetic elements under the agitating and conveying members at the bottom of the developing hopper makes it possible to form magnetic brushes in cooperation with the magnetic source elements embedded in the rotational shafts of the agitating and conveying members, the spikes of the developer with a content of magnetic carrier that have shrunken by being attracted to the rotational shaft sides can be stretched by the magnetic elements at the bottom. As a result, the input toner lumps can be crushed so that the toner can be efficiently mixed and agitated with magnetic carrier.

Further, provision of the developing unit of the present invention in an image forming apparatus makes it possible, even if the image forming apparatus is a high-speed machine, to sufficiently crush the supplied toner in a short time and mix and agitate toner with the existing developer, with the rotational rate of the agitating and conveying members such as agitating and conveying screws or the like set at the low level as is or without enhancing the rotational rate to a higher level. As a result, it is possible to prevent occurrence of density unevenness in the image formed on the recording medium such as paper etc., due to agitation failure. Accordingly, realization of image forming is possible for application of high speed machine wherein staying period of supplied developer in developing hopper is short. Further, since the agitating and conveying members are not rotated at a high speed but are driven at a low rotational speed, it is possible to alleviate stress on the developer hence increase the developer life.

Though the above description was made taking an example of a preferred embodiment of the present invention with reference to the accompanying drawings, it goes without saying that the present invention should not be limited to this example. It is apparent that various modifications, variations and modified examples will occur to those skilled in the art without departing from the spirit or scope of the following claims, and those should be considered to be within the technical scope of the invention.

For example, in the above first embodiment, the present invention is applied to the developing unit to be mounted in a monochrome image forming apparatus having a single toner container. However, the present invention can be also applied to the developing units for a color image forming apparatus in which a plurality of toner containers are mounted.

Moreover, though, in the above first embodiment a pair of first and second agitating and conveying screws are provided as the developer agitating and conveying members, the present invention can be applied to a configuration including three or more developer agitating and conveying members as long as at least a pair of the agitating and conveying members is provided in the developer hopper and the rotational shafts of the developer agitating and conveying members are embedded with shaft-side magnets and toner is supplied into and between the rotational shafts of these developer agitating and conveying members, similarly to the above-described first embodiment.

What is claimed is:

1. A developing unit for developing an electrostatic latent image born on an image bearing member with a developer that has been charged by mixing and agitating toner and magnetic carrier, comprising:

a developing hopper for holding the developer;

a developer bearing member for bearing the developer having been mixed and agitated in the developing hopper and supplying the developer to a developed area arranged opposing the image bearing member; and at least a pair of agitating and conveying members rotationally driven in the developing hopper for conveying the developer while agitating, agitating and conveying members being arranged substantially parallel to the developer bearing member and each rotational shaft of the agitating and conveying members is embedded with a magnetic source element whose magnetic poles are laid out so as to generate a magnetic field in a radial direction from the rotational shaft of the agitating and conveying member; and a toner supply port for supplying the toner into the developing hopper is arranged over the paired agitating and conveying members.

2. The developing unit according to claim 1, wherein the magnetic source elements embedded in the rotational shafts comprise a magnetic pole-face on the shaft surface side of each rotational shaft, and the magnetic pole-faces on the shaft surface side present the same magnetic polarity.

3. The developing unit according to claim 1, wherein a magnetic element is arranged under each of the agitating and conveying members and at the bottom of the developing hopper, so that its one magnetic pole that opposes the corresponding magnetic source element has a magnetic polarity opposite that of the magnetic pole-face of the magnetic source element.

4. The developing unit according to claim 1, wherein the paired agitating and conveying members are rotationally driven so that the magnetic pole-faces of the magnetic source elements embedded in the rotational shafts oppose each other in synchronism.

5. The developing unit according to claim 1, wherein the toner from the toner supply port is adapted to fall into the developing hopper only when the two magnetic pole-faces oppose each other.

6. The developing unit according to claim 1, wherein the magnetic source elements embedded in the rotational shafts of the paired agitating and conveying members exert approximately equivalent magnetic forces.

7. The developing unit according to claim 1, wherein the paired agitating and conveying members have approximately equivalent conveying performances for conveying the developer.

8. The developing unit according to claim 1, wherein the magnetic strengths of the magnetic source elements are set in dependence upon a distance between the paired agitating and conveying members.

9. The developing unit according to claim 1, wherein the longitudinal length of the magnetic source element is greater than the longitudinal length of the toner supply port.

10. An image forming apparatus comprising:

a developing unit for developing an electrostatic latent image born on an image bearing member with a developer including toner; and a transfer portion for transferring the toner image developed on the image bearing member to a recording medium to form an output image, wherein the developing unit employs the developing unit according to claim 1.

* * * * *